United States Patent [19]

Patterson, Jr.

[11] 4,089,129

[45] May 16, 1978

[54] SIGN SUSPENSION DEVICE

[75] Inventor: Ward W. Patterson, Jr., St. Louis County, Mo.

[73] Assignee: Stout Industries, Inc., St. Louis, Mo.

[21] Appl. No.: 732,606

[22] Filed: Oct. 15, 1976

[51] Int. Cl.[2] ..... G09F 7/22

[52] U.S. Cl. ..... 40/606; 40/617; 248/317

[58] Field of Search ..... 40/128, 125 H, 125 K, 40/145 R; 248/61, 62, 63, 214, 317; 16/109, 150; 52/38, 39, 484; 403/164, 243, 371

[56] References Cited

U.S. PATENT DOCUMENTS

| | | | |
|---|---|---|---|
| 657,712 | 9/1900 | Thomas | 403/371 X |
| 3,009,747 | 11/1961 | Pitzer | 403/243 X |
| 3,043,039 | 7/1962 | Battaglia | 40/138 |
| 3,126,575 | 3/1964 | Schoeneberg | 248/317 X |
| 3,612,460 | 10/1971 | Smith | 40/125 H X |

*Primary Examiner*—John F. Pitrelli
*Attorney, Agent, or Firm*—Ralph W. Kalish

[57] ABSTRACT

A sign suspension device for use with a placard type sign having a base portion for engagement to a rigid support; there being a plurality of hinge rod components integrally formed with said base portion for receiving bearing collars. A strap-like hinge is engaged upon said collars and secured to a sheet member constituting the sign.

7 Claims, 4 Drawing Figures

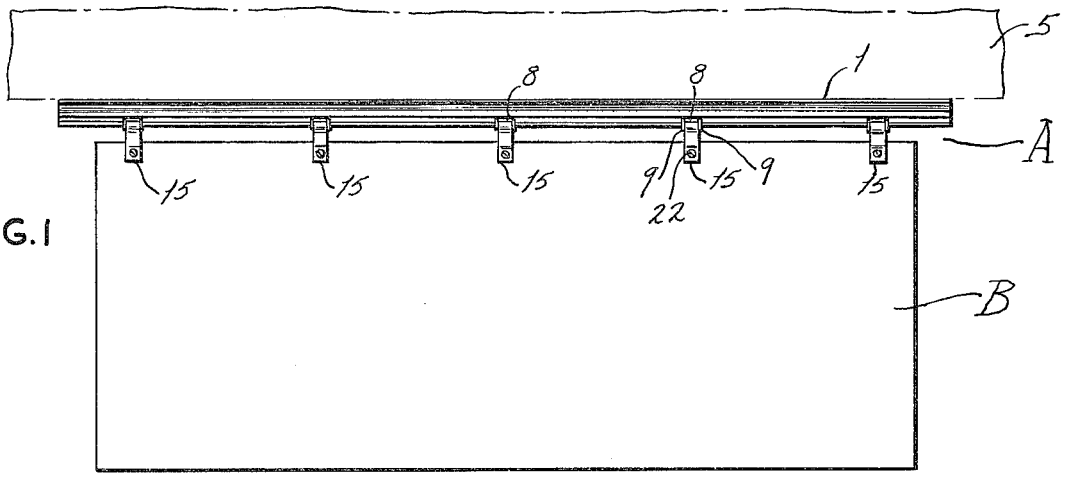
FIG. 1
FIG. 2
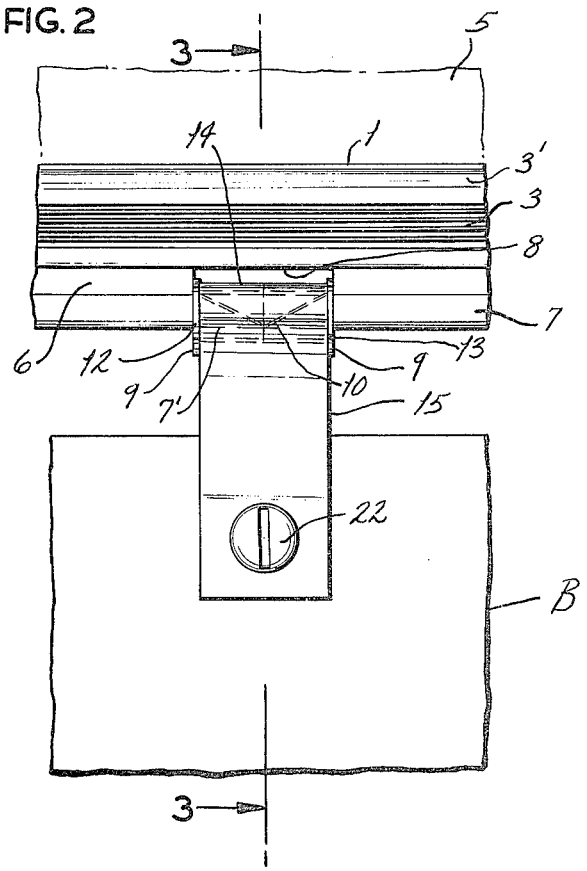
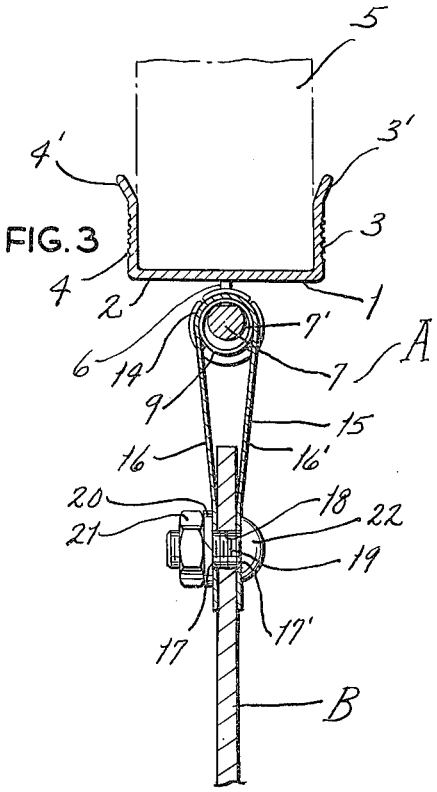
FIG. 3
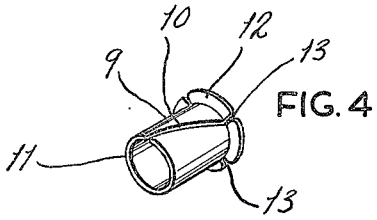
FIG. 4

SIGN SUSPENSION DEVICE

BACKGROUND AND SUMMARY OF THE INVENTION

This invention relates to novel and unusual means for suspending sheet-like members such as utilized particularly for sign purposes. Heretofore, there have been various efforts to develop means to swingably support signs of the placard type, but such have consistently proven ineffective in various respects. One such deficiency has been the costly manufacture of the component for securement to the fixed suspending agent. Thus, channel-shaped extrusions have been developed which must be punched or apertured in the web portions for extension therethrough of the legs of specially cast components which carry bearing rod sections. Such cast components require appropriate interfit for assembly and have proven increasingly costly in production. Furthermore, it has been difficult to integrate such components so as to prevent longitudinal shifting of the same with resultant undesired displacement of the supported sign.

Therefore, it is an object of the present invention to provide a sign suspension system which is easily adapted for securement to any selected support member which may be either horizontally or vertically disposed and with the securement thereto effected in any conventional appropriate manner.

Another object of the present invention is to provide a system as described which embodies a paucity of components, all of which may be most economically manufactured and which are resistant to breakdown.

It is another object of the present invention to provide a system of the character stated which presents a smooth bearing so that the suspended sign may swing easily under any wind forces that may be encountered during usage without the likelihood of damage.

It is a still further object of the present invention to provide a system of the character stated wherein the components are so uniquely inter-related that assemblage may be effected by unskilled individuals so that the various components may be forwarded to a user in a knock-down or unassembled state.

It is a further object of the present invention to provide a system of the character stated which is extremely reliable and durable in usage; which obviates frequent inspection as is the custom with present constructions and thereby further reduce costs of operation; and which is extremely versatile in usage, being obviously adapted for myriad applications.

BRIEF DESCRIPTION OF THE DRAWINGS

FIG. 1 is a front view of a sign suspension device constructed in accordance with and embodying the present invention, illustrating same in operative condition.

FIG. 2 is an enlarged front fragmentary view illustrating a single suspension component.

FIG. 3 is a vertical transverse sectional view taken on the line 3—3 of FIG. 2.

FIG. 4 is a perspective view of a bearing sleeve.

DESCRIPTION OF THE PREFERRED EMBODIMENT

Referring now by reference numerals to the drawings which illustrate the preferred embodiment of the present invention, A generally designates a suspension system for a flat sheet-like element B which may, for purposes of example only, be of relatively thin gage sheet metal and adapted to provide preselected indicia (not shown) on either or both faces as for advertising, instructional, or related purposes. Said sheet element B is free at its lower end and, as will be shown, is swingably supported by suspension system A so that it is free to rock responsively to any wind forces directed thereagainst. Accordingly, the purpose of suspension system A is to provide means for effectively retaining sheet member B in preferably depending state for customary placard usage, such as primarily at outdoor sites associated with various business and commercial establishments, including, by way of example only, gasoline service stations, markets, etc.

Said suspension system A embodies an elongated support member 1 which may be of any suitable rigid material, desirably metal and formed by extrusion, having an upper portion which is generally U-shaped comprising a flat base 2 and opposed side flanges 3, 4, which latter may be directed outwardly or away from each other, as at 3', 4', respectively, for purposes presently appearing. The upper portion of member 1 may be open at its ends so that it may be easily cut to length from an extrusion.

Support member 1 is adapted to receive any suitable stable element as suggested at 5, and which may be a pipe, a cross bar on a prearranged frame, an overhead member within an existing structure, etc. The outturned edges of flanges 3, 4 facilitate reception of a pipe and, as will be suggested hereinbelow, such elements may be vertically disposed in the event it was desired to present sheet member B for swinging about a vertical axis rather than a horizontal axis, as indicated in the drawings. Any suitable fastening arrangement may be adopted for securing the said upper portion of body 1 to the particular element; thus base 2, as well as flanges 3, 4 may be drilled for extension therethrough of screws or bolts, and if desired clamps, if feasible, may be utilized as well as wire and the like.

The only criterion is that body 1 be made fast to the particular element 5. The particular type of fastening means will be dictated entirely by the character of the element 5.

Said support member 1 integrally incorporates a lower portion comprising a coextensive, relatively thin web 6 depending from the underface of base 2 intermediate the width thereof for integrally connecting said base 2 with a rod-like portion 7, being circular in cross section, which is also of the same length as extrusion 1. As will best be seen in FIG. 3, the diameter of rod like portion 7 is substantially greater than the thickness of web 6.

Spacedly provided within web 6, at preselected intervals, are apertures 8 whereby the intervening portion of rod like portion 7 is fully exposed for providing what might be considered hinge rod sections 7'. Provided upon each hinge rod section 7' is a pair of cooperating split bearing sleeves 9. Each bearing sleeve 9 is provided with a spirally extending opening 10 to permit said sleeves 9 to be sufficiently opened or spread to permit the same to be received upon hinge rod section 7' of rod-like portion 7; the contour of said line of opening thus preventing inadvertent or unauthorized displacement of said sleeves 9 from hinge rod section 7'during usage. In operative position upon each hinge rod section 7' the respective sleeves 9 will be in end to end abutting relationship at their normally inner ends, as at 11, so as to provide a substantially continuous bearing and at their other or outer ends each sleeve 9 embodies an end flange 12, the dimension of the radial extent of which will become more apparent hereinbelow. Said end flanges 12 are provided with a series of circumferentially spaced openings 13 thereby adapting said flanges to flex without rupture upon opening of said sleeves and disposition upon hinge rod section 7'. Sleeves 9 are of such length so that when in paired relationship, as shown in FIG. 2, they will fully cover the related hinge rod section 7' with the outer faces of the respective flanges 12 abutting against the proximate exposed faces of connecting webs 6. Consequently, undesired longitudinal displacement of said sleeves 9 is thereby inhibited.

Received upon the pair of sleeves 9 within each opening 8 is the upper rounded end 14 of a hinge or strap 15 incorporating a pair of opposed arms 16, 16' extending from the rounded end 14 and having aligned apertures 17, 17' proximate their lower ends for alignment with an opening 18 formed in the upper portion of member B for accommodating a short bolt 19 extending therethrough and having a washer and nut, as at 20, 21 secured upon its end remote from its head 22 for maintaining said hinge 15 rigidly to member B.

In FIG. 1 the embodiment illustrates a sheet element B suspended by five hinges 15. But obviously the number of such hinges is entirely a matter of choice with considerations being given to dimensions of sheet member B, the width thereof, the environmental conditions to which it may be subjected, etc. etc.

Accordingly, in view of the foregoing it will be seen that sheet member B is securely supported by hinges 15 and although may most commonly be presented in a suspended state for swinging about a horizontal hinge axis, it is to be understood that the present invention also contemplates the presentation of support member 1 at 90° to that shown in FIG. 1 whereby sheet B may be presented for swinging about a vertical axis.

It will be seen that the provision of a rod-like member to an easily formed extrusion permits of the development of a most effective hinge arrangement which may be fabricated of extremely cheaply produced components and which may be assembled in such a facile fashion that the entire unit could be shipped in a knock-down state to the user. The relationship of sleeves 9, hinge 15, and hinge section 7' are such that displacement of sign B longitudinally of rod-like portion 7 is effectively inhibited thereby conducing to increased longevity of usage and rendering the same resistant to breakdown.

The present invention represents a marked departure from the structures heretofore utilized for like purposes which have been unreliable in usage; have required a level of skill in assembly, as well as necessitated production of costly components.

Having thus described my invention, what I claim and desire to obtain by Letters Patent is:

1. For use with a rigid suspension support and a flat sheet-like sign-constituting member, a sign suspension device comprising an elongated rigid support member integrally formed to provide a coextensive mounting portion being of U-shape cross-section having a flat base and opposed side flanges, the volume of said U-shaped section being adapted to receive the suspension support and means for securing said U-shaped section to said support, there being integral with said suspension device and projecting from the exterior base portion of said U-shaped section a relatively thin web coextensive with said suspension device and there being a rod-like section integral with said web along its U-shaped section remote portion, said web having a plurality of longitudinally spaced-apart openings for cooperating with said rod to define discrete hinge rod forming sections, bearing sleeves detachably engaged upon said hinge rod forming sections, and connector means swingably disposed upon each hinge rod forming section and having extensions therebeyond, and means engaging said extensions of said connector means to said sign constituting member.

2. A sign suspension device as defined in claim 1 and further characterized by said hinge rod forming sections being coaxial and provided spacedly longitudinally of said elongated body.

3. A sign suspension device as defined in claim 2 and further characterized by a pair of said bearing sleeves being provided on each hinge rod forming section and being in abutment at one of their proximate ends.

4. A sign suspension device as defined in claim 3 and further characterized by each of said sleeves being fabricated of flexible material and having a spiral line of opening throughout their length facilitating reliable engagement upon the related hinge rod forming section.

5. A sign suspension device as defined in claim 4 and further characterized by each of said bearing sleeves being provided with a radially projecting flange at their end remote from their abutting ends, said flanges providing stops for the engaged portion of the related strap.

6. A sign suspension device as defined in claim 5 and further characterized by said bearings on each hinge rod forming section having a joint length substantially equal to the length of the engaged hinge rod forming section, said bearing flanges abutting on their mutually remote faces against the adjacent edge of the associated web opening.

7. A sign suspension device as defined in claim 6 and further characterized by each connector being fabricated of flat strap-like stock and bent upon itself to provide a bight portion receivable upon the associated bearing sleeves and a pair of legs, said means securing said said legs to said sheet-like member being provided in the portions of said legs remote from the related bight portion.

* * * * *